US010697446B2

(12) United States Patent
Winefordner et al.

(10) Patent No.: US 10,697,446 B2
(45) Date of Patent: Jun. 30, 2020

(54) FLOOR PUMP

(71) Applicant: Crank Brothers, Inc., Laguna Beach, CA (US)

(72) Inventors: Carl Winefordner, Laguna Beach, CA (US); Frank Hermansen, Laguna Beach, CA (US)

(73) Assignee: CRANK BROTHERS, INC., Laguna Beach, CA (US)

( * ) Notice: Subject to any disclaimer, the term of this patent is extended or adjusted under 35 U.S.C. 154(b) by 592 days.

(21) Appl. No.: 15/336,484

(22) Filed: Oct. 27, 2016

(65) Prior Publication Data

US 2018/0119684 A1 May 3, 2018

(51) Int. Cl.

| | |
|---|---|
| ***F04B 39/14*** | (2006.01) |
| ***F04B 33/00*** | (2006.01) |
| ***F04B 37/12*** | (2006.01) |
| ***F04B 39/00*** | (2006.01) |
| ***F04B 39/12*** | (2006.01) |
| ***F04B 51/00*** | (2006.01) |
| ***F04B 53/10*** | (2006.01) |

(52) U.S. Cl.

CPC ..... *F04B 39/14* (2013.01); *F04B 33/00* (2013.01); *F04B 33/005* (2013.01); *F04B 37/12* (2013.01); *F04B 39/0005* (2013.01); *F04B 39/12* (2013.01); *F04B 51/00* (2013.01); *F04B 53/10* (2013.01)

(58) Field of Classification Search

CPC .. F04B 9/14; F04B 17/06; F04B 19/04; F04B 19/20; F04B 19/22; F04B 33/00; F04B 33/005; F04B 35/06; F04B 37/10; F04B 37/12; F04B 37/18; F04B 39/0005; F04B 39/0022; F04B 39/12; F04B 39/14; F04B 51/00; F04B 53/10; F04B 53/22

USPC ..... 417/234, 545, 553, 555.1, 63; 285/9.1; 73/700

See application file for complete search history.

(56) References Cited

U.S. PATENT DOCUMENTS

| | | | | |
|---|---|---|---|---|
| 9,057,364 | B2 | 6/2015 | Gerritsen | |
| 2015/0110646 | A1* | 4/2015 | Wu | F04B 33/005 417/63 |
| 2017/0167477 | A1* | 6/2017 | Hermansen | F04B 33/005 |

OTHER PUBLICATIONS

Author: Tyler Benedict Title: EB16: Crank Brothers gets into cyclocross wheels Date published (mm/dd/yyyy): Aug. 31, 2016 Date accessed (mm/dd/yyyy): May 13, 2019 Link: https://bikerumor.com/2016/08/31/eb16-crank-brothers-gets-cyclocross-wheels-updates-others-plus-new (Year: 2016).*

Author: crankbrothers Title: How to use crankbrothers klic pump Date published (mm/dd/yyyy): Jan. 19, 2017 Date accessed (mm/dd/yyyy): May 13, 2019 Link: https://www.youtube.com/watch?v=JCKV4IULahs (Year: 2017).*

(Continued)

*Primary Examiner* — Patrick Hamo
*Assistant Examiner* — Chirag Jariwala
(74) *Attorney, Agent, or Firm* — Tutunjian & Bitetto, P.C.

(57) ABSTRACT

A floor pump comprises a support base, an outer rigid tube rising from the support base and delimiting a first air chamber, an inner rigid tube or shaft having a piston at one end and a handle at the other end, which piston is slidingly mounted within the first air chamber so as to compress air therewithin. The floor pump may further include a flexible hose.

17 Claims, 11 Drawing Sheets

(56) References Cited

OTHER PUBLICATIONS

Author: BikeFactory Title: Bombin beto CJA-001S tubeless Date published (mm/dd/yyyy): Jan. 30, 2016 Date accessed (mm/dd/yyyy): May 13, 2019 Link: https://www.bikefactory.cl/5806-bombin-beto-cja-001s-tubeless.html (Year: 2016).*

Author: road.cc Title: Tyre Booster Comparison Date published (mm/dd/yyyy): Jan. 28, 2017 Date accessed (mm/dd/yyyy): May 13, 2019 Link:https://www.youtube.com/watch?v=lxRbEcxsC5M&t=190s (Year: 2017).*

* cited by examiner

FLOOR PUMP

BACKGROUND

Technical Field

The present invention relates to a floor pump and a hose assembly for a floor pump or for a burst tank.

Related Art

Typically, a floor pump comprises a base to stand on for stabilizing the pump, an outer rigid tube forming a chamber, an inner rigid tube or shaft with a piston at one end, and a handle at the other end. The piston is designed to compress air within the chamber. The floor pump further includes a flexible hose attached to the base and provided with a head. The flexible hose is designed to put in fluid communication the end of the chamber and a tire valve. Moreover, a gauge is mounted either to the base or along the outer tube for displaying air pressure. Usually, the flexible hose is wrapped to or over the handle when the pump is stored in order to both prevent the hose from dangling obtrusively on the floor and to prevent the handle from extending when the pump is carried in the stored position.

More recently, floor pumps having either an integrated "burst tank" or an independent "burst tank" for attachment to a floor pump have been proposed. The purpose of the "burst tank" is to help seat a tubeless tire on a rim by providing a high flow (blast) of air into the tire. The "burst tank" is inflated by the floor pump to about 160 psi, and then the air within the burst tank is released rapidly into the tire. In order to seat a tubeless tire onto a rim, a rapid burst of air, which is usually not possible by pumping action alone, is required. The gauge on existing floor pumps is built into the pump and it cannot be used for an independent burst tank or to measure tire pressure independently.

Moreover, it is convenient if the floor pump can be picked up by the handle without the handle extending from the rest of the pump. U.S. Pat. No. 9,057,364 discloses a hand pump wherein the piston is magnetically held closed. However, this causes a major disadvantage that during use, on every pump stroke, the magnet engages with the piston causing increased pumping effort. Currently, handles are held closed on floor pumps by wrapping the flexible hose over the handle.

It should also be considered that the flexible hose of traditional floor pumps is external even when stored, adding size and looking disorganized. The flexible hose is cumbersome to pull up off the floor, wrap over the handle, and clip into mounts intended to secure the flexible hose in place and hold the handle closed. If the hose is not secured, it can cause a tripping hazard.

When a burst tank is built into the floor pump, it adds weight and size all the time, even though the burst function is only rarely used (for example, when seating a tire on a rim, which is perhaps only once every few months). Burst tanks are typically made of steel and relatively heavy, so building a burst tank into a floor pump often doubles the weight of the pump. When the burst tank is not needed but cannot be bypassed, there is a large inefficiency because the burst tank is filled every time to the tire pressure during normal pumping even when the burst function is not being used.

SUMMARY

Novel floor pumps are provided according to various embodiments. In one aspect, a floor pump has a gauge which can be easily and rapidly assembled and dismounted so that the same gauge can be used for two different floor pumps, for an independent burst tank, or to measure tire pressure independently. In another aspect, the floor pump may have a burst tank. In another aspect, the floor pump may be provided with a handle that does not interfere during pump use. In yet another aspect, the floor pump may be more compact when stored.

According to a first aspect of the present invention, a floor pump according to the present application is provided. According to a second aspect of the present invention, a hose assembly according to the present application is provided. The present specification refers to embodiments of the present invention.

BRIEF DESCRIPTION OF THE FIGURES

These and other advantages will be better understood by one skilled in the art from the following description and from the attached drawings, given as non-limiting examples, in which.

DETAILED DESCRIPTION

Figure 1:
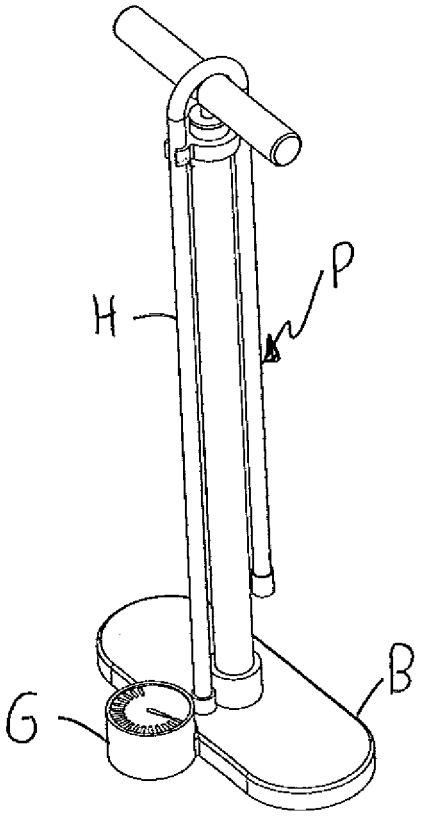
FIG. 1 PRIOR ART
FIGS. 1 and 2 are perspective views of a floor pump according to the prior art with a flexible hose assembly stored and laying on the floor, respectively.
Figure 2:
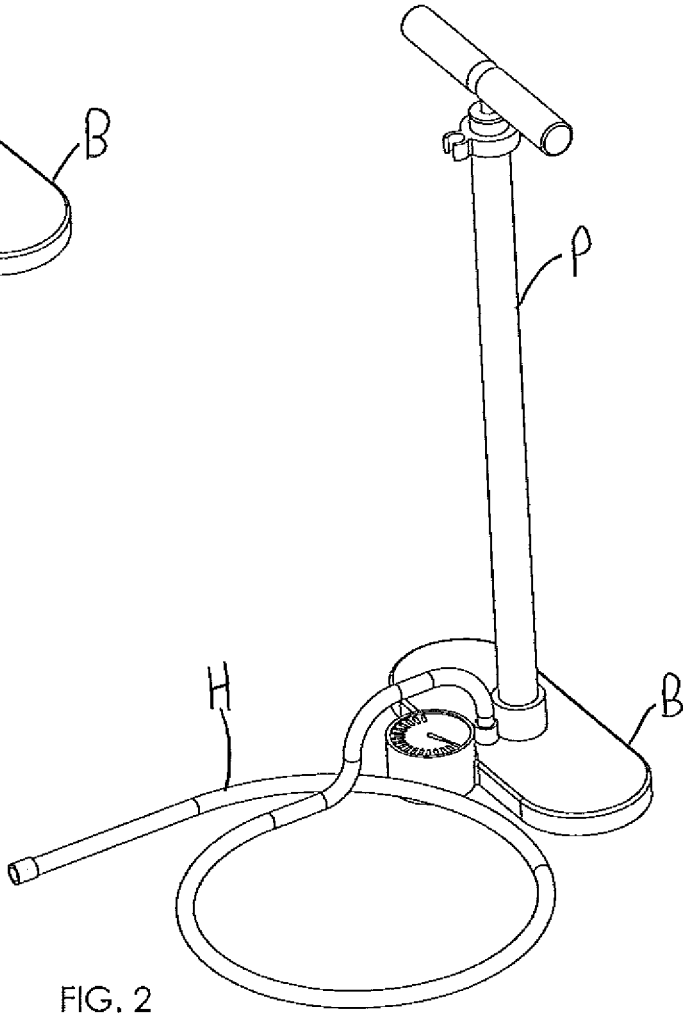
FIG. 2 PRIOR ART
Figure 3:
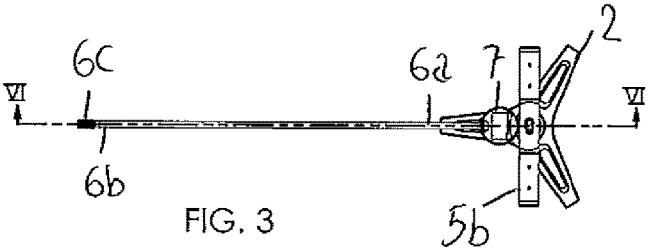
FIGS. 3, 4, and 5 show a top, side, and perspective view, respectively, of a floor pump with a gauge assembly almost installed according to an embodiment of the present invention.
Figure 4:
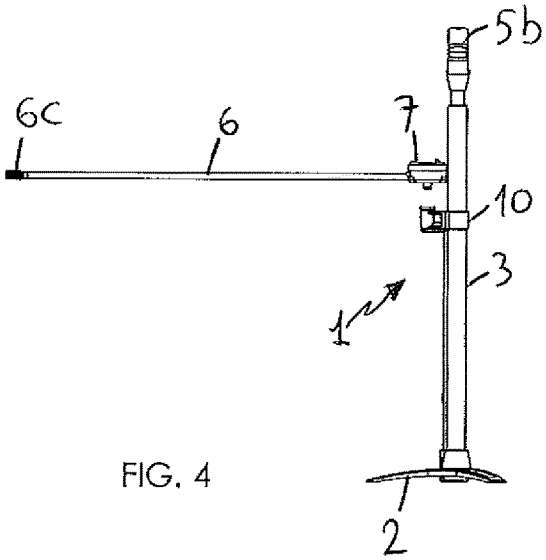
Figure 5:
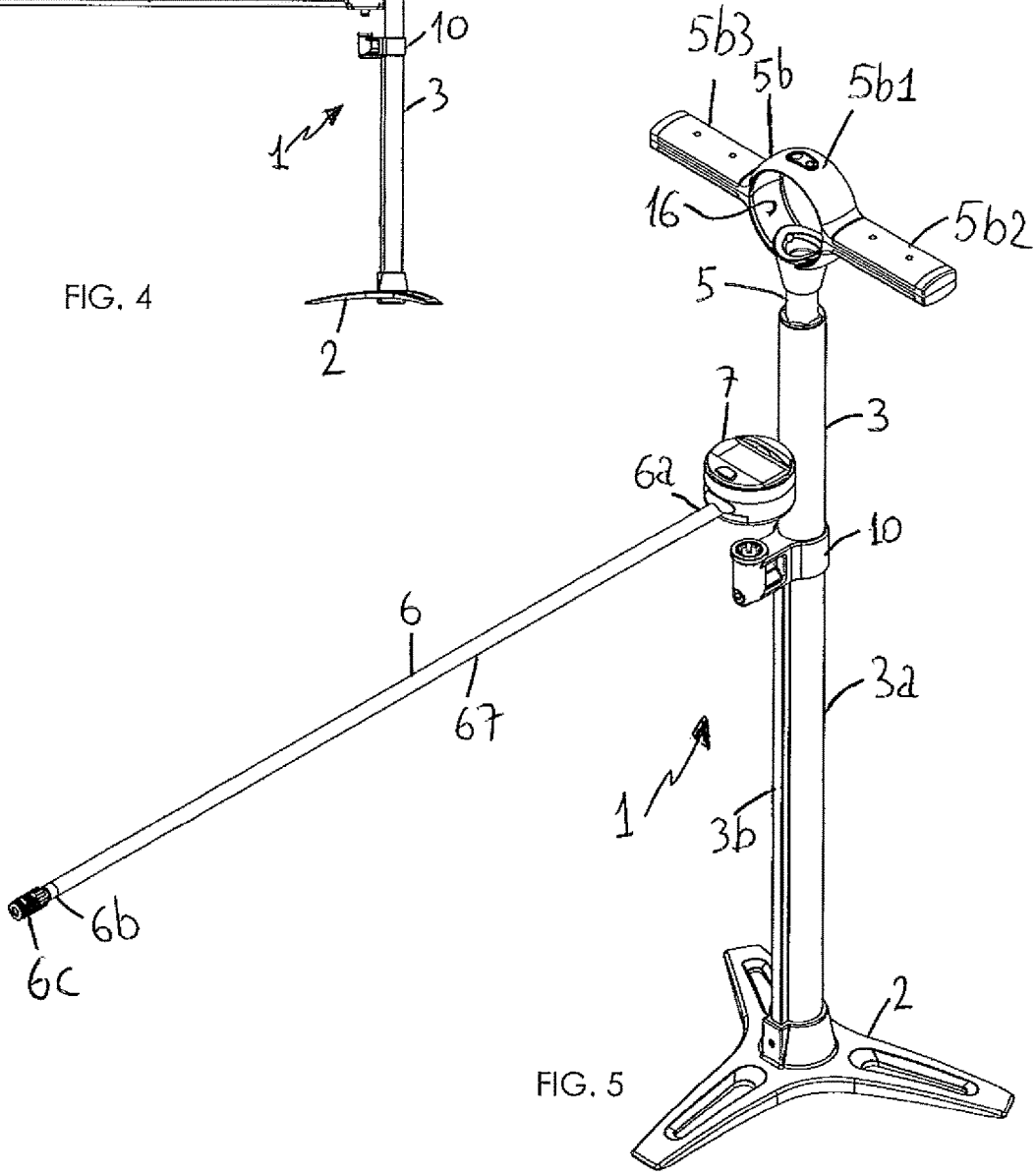
Figure 6:
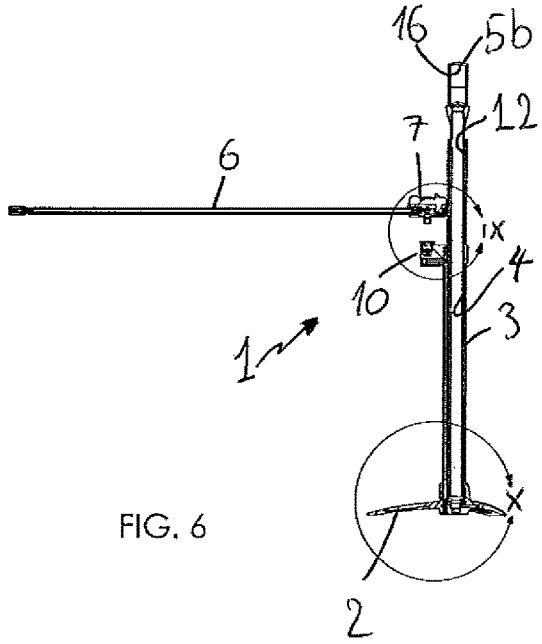
FIG. 6 shows a cross-section view taken along the line VI-VI of FIG. 3.
Figure 7:
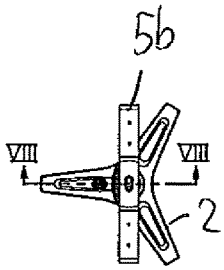
FIG. 7 is a top view of the floor pump of FIG. 3 with the gauge assembly stored.
Figure 8:
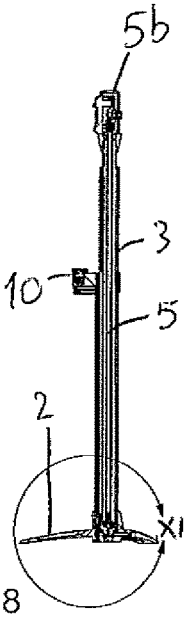
FIG. 8 shows a cross-section view taken along the line VIII-VIII of FIG. 7.
Figure 9:
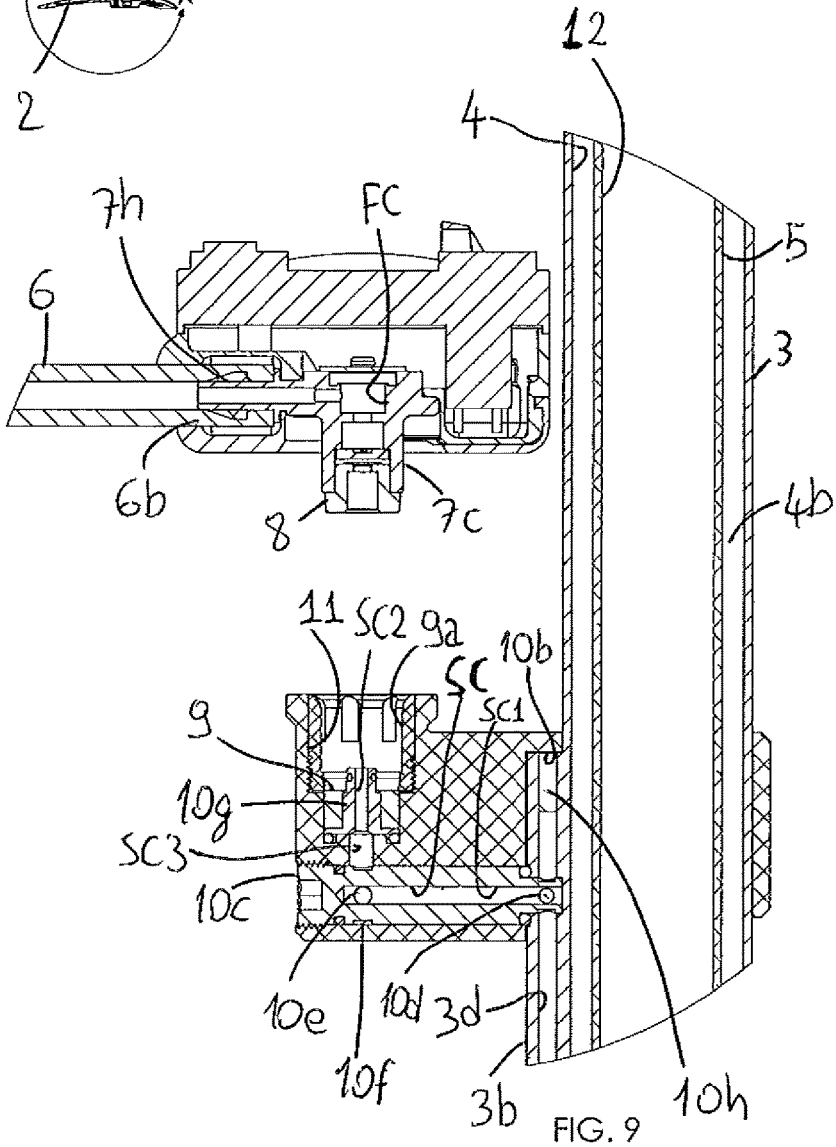
FIG. 9 is an enlarged view taken along the line IX of FIG. 6.
Figure 10:
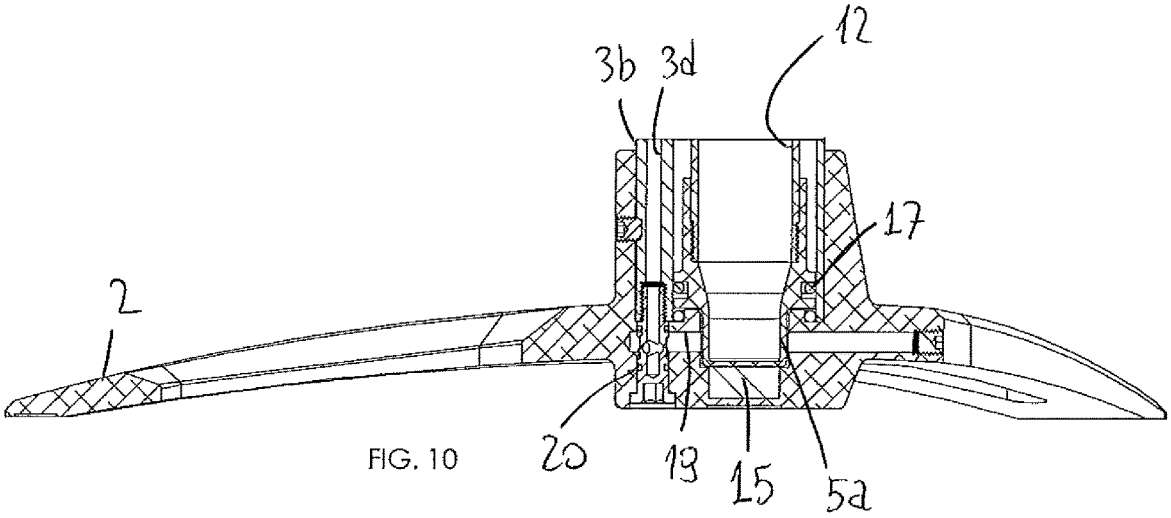
FIG. 10 is an enlarged view of the base of the floor pump taken along the line X of FIG. 6.
Figure 11:
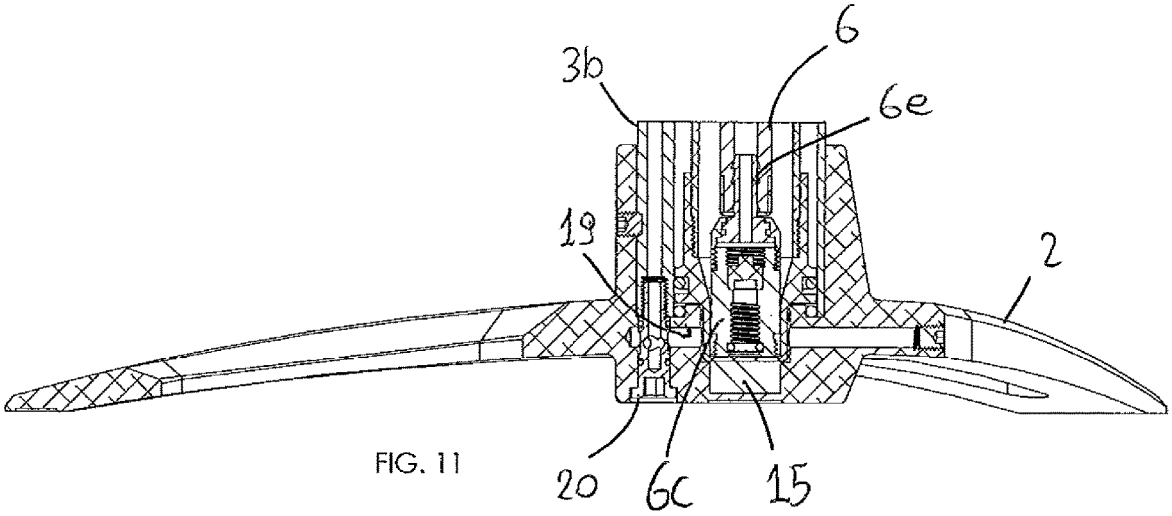
FIG. 11 is an enlarged view of the base of the floor pump taken along the line XI of FIG. 8.
Figure 12:
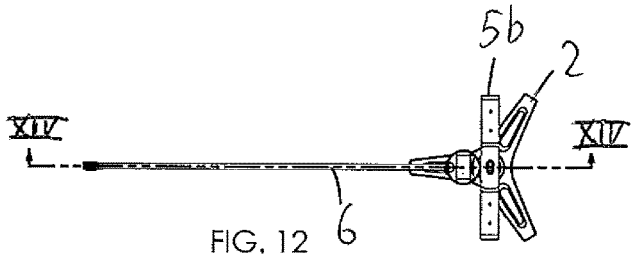
FIGS. 12 and 13 are a top and side view, respectively, of the floor pump of FIG. 3 with gauge assembly mounted and the piston not fully compressed.
Figure 13:
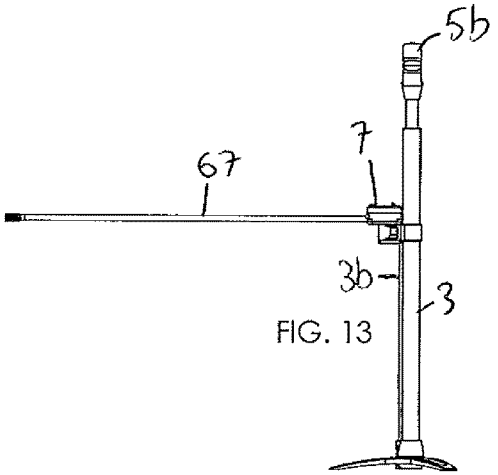
Figure 14:
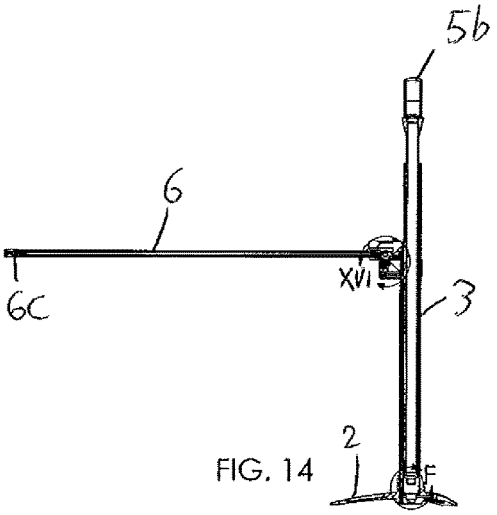
FIG. 14 shows a cross-section view taken along the line XIV-XIV of FIG. 12.
Figure 15:
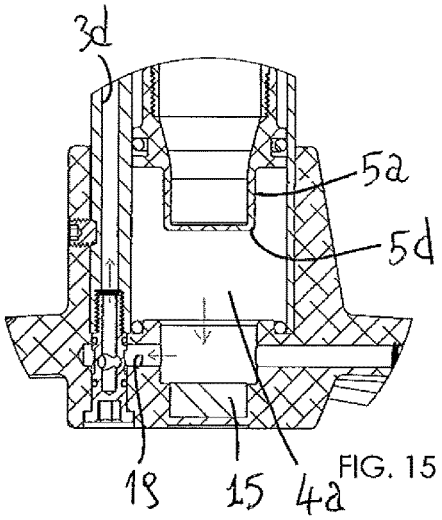
FIG. 15 is an enlarged view of the base of the pump of FIG. 14.
Figure 16:
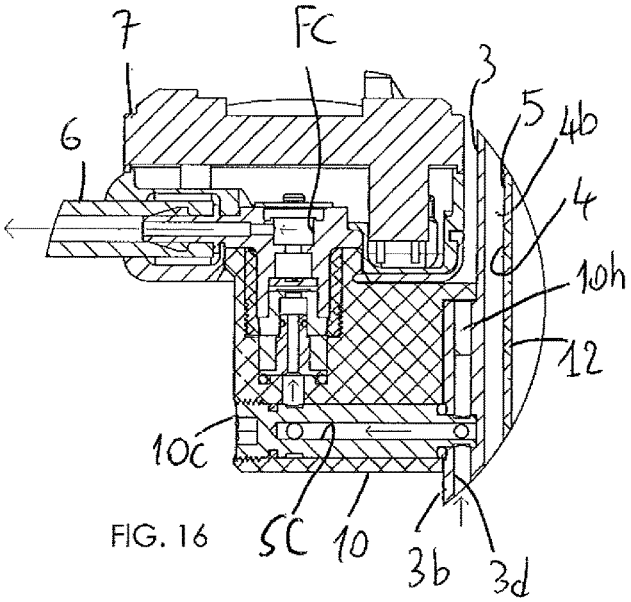
FIG. 16 is an enlarged view taken along the line XVI of FIG. 14.
Figure 17A:
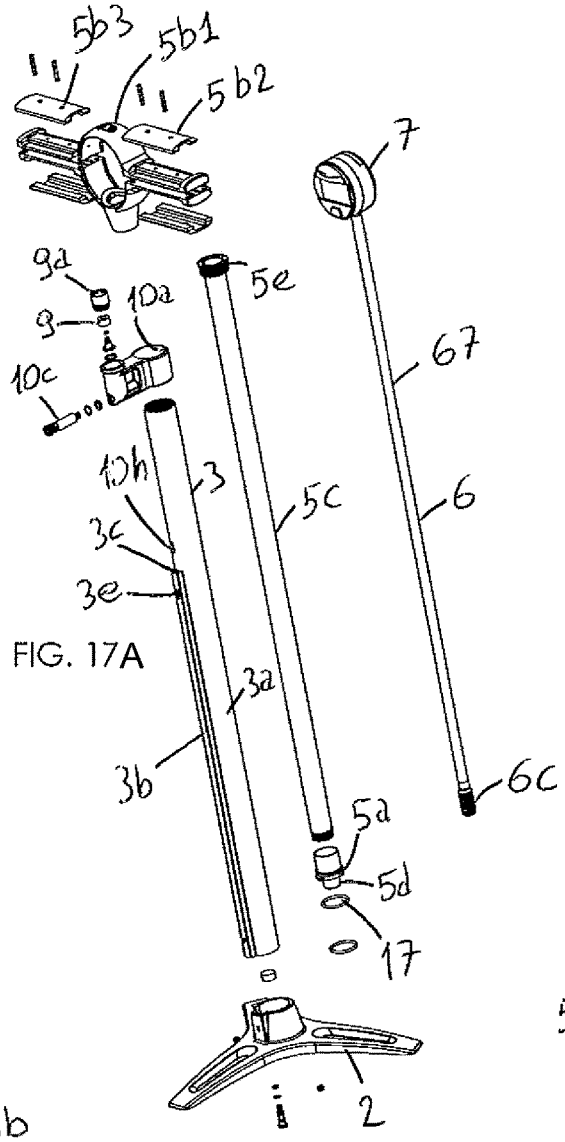
FIG. 17A is an exploded view of the floor pump of FIG. 3.
Figure 18:
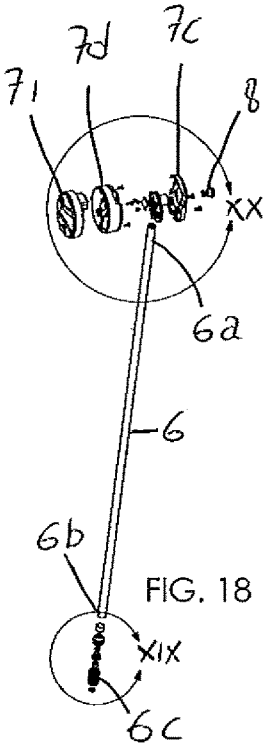
FIG. 18 is an exploded view of a hose assembly of the floor pump of FIG. 3.
Figure 17B:
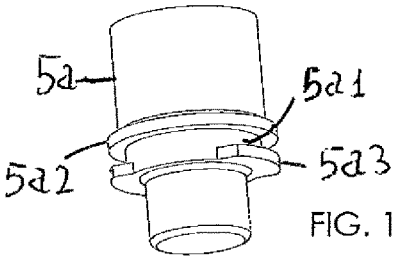
FIG. 17B shows an enlarged view of a piston of the floor pump shown in FIG. 17A.
Figure 19:
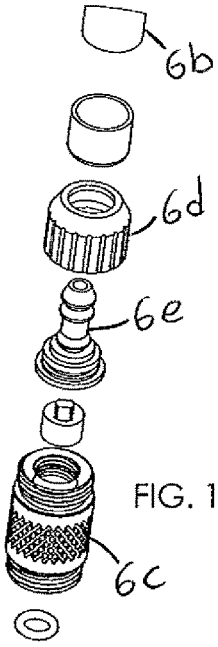
FIGS. 19 and 20 show enlarged views taken along the lines XIX and XX of FIG. 18, respectively.
Figure 20:
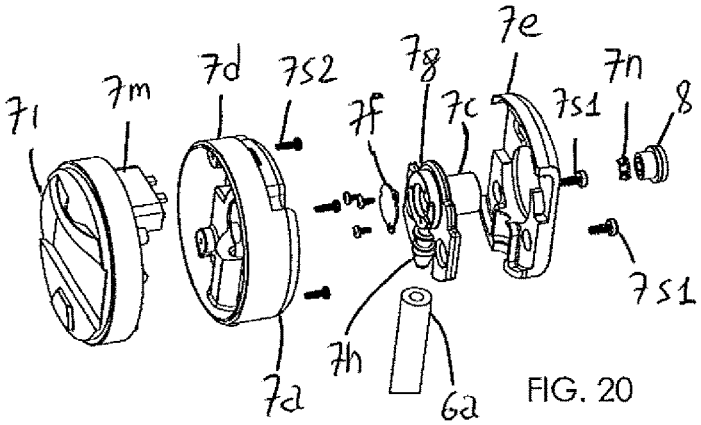
Figure 21:
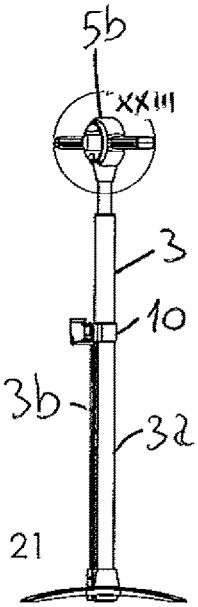
FIG. 21 shows a perspective view of the floor pump of FIG. 3 with the hose assembly stored.
Figure 22:
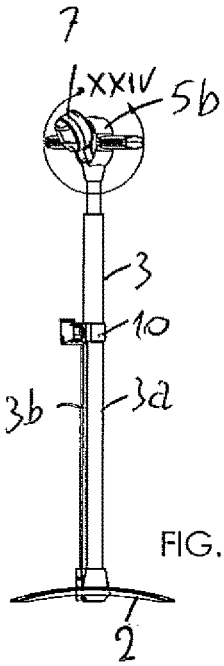
FIG. 22 shows a perspective view of the floor pump of FIG. 3 with the hose assembly partially installed.
Figure 23:
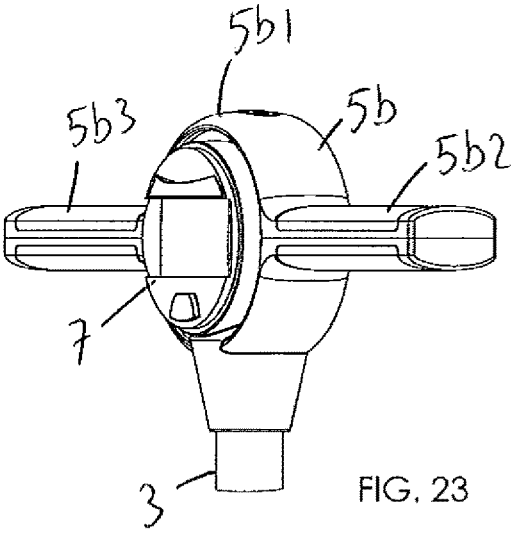
FIGS. 23 and 24 show enlarged views taken along the line XXIII of FIG. 21 and the line XXIV of FIG. 22, respectively.
Figure 24:
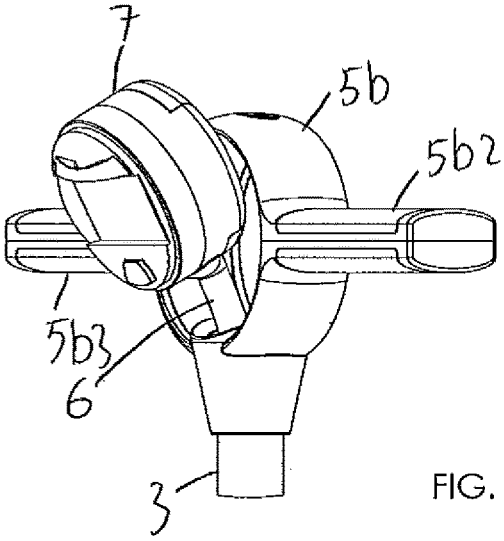
Figure 25:
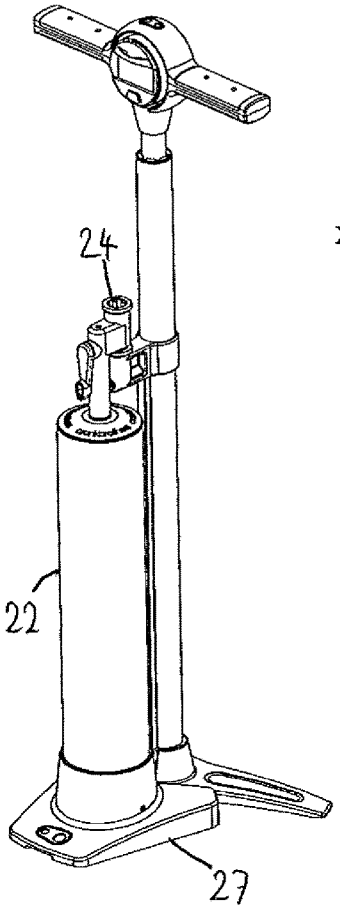
FIG. 25 shows a perspective view of a floor pump with a burst tank according to an embodiment of the present invention.
Figure 26:
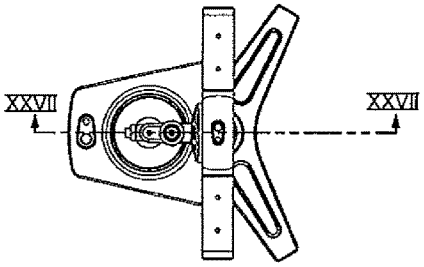
FIG. 26 shows a top view of the floor pump of FIG. 25.
Figure 27:
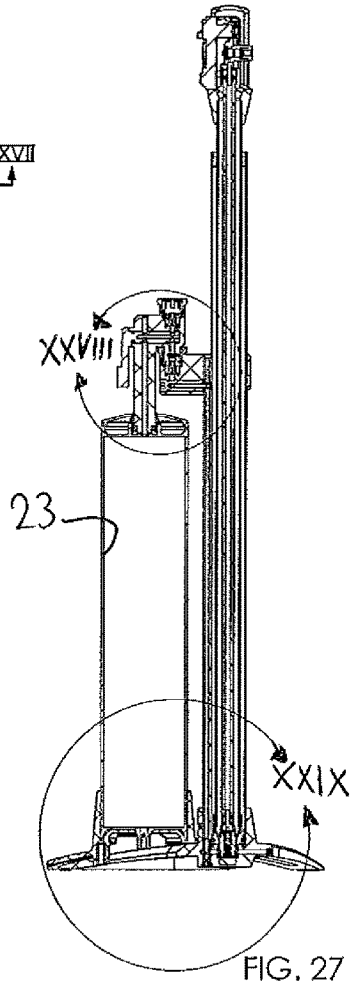
FIG. 27 shows a cross-section view taken along the line XXVII-XXVII of FIG. 26.
Figure 28:
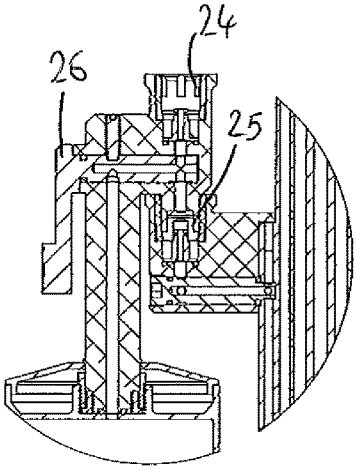
FIGS. 28 and 29 show an enlarged view taken along the lines XXVIII and XXIX of FIG. 27, respectively.
Figure 29:
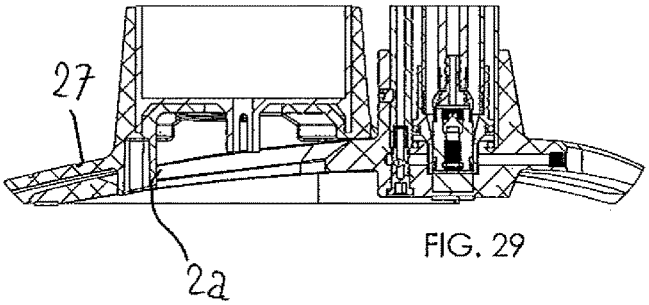
Figure 30:
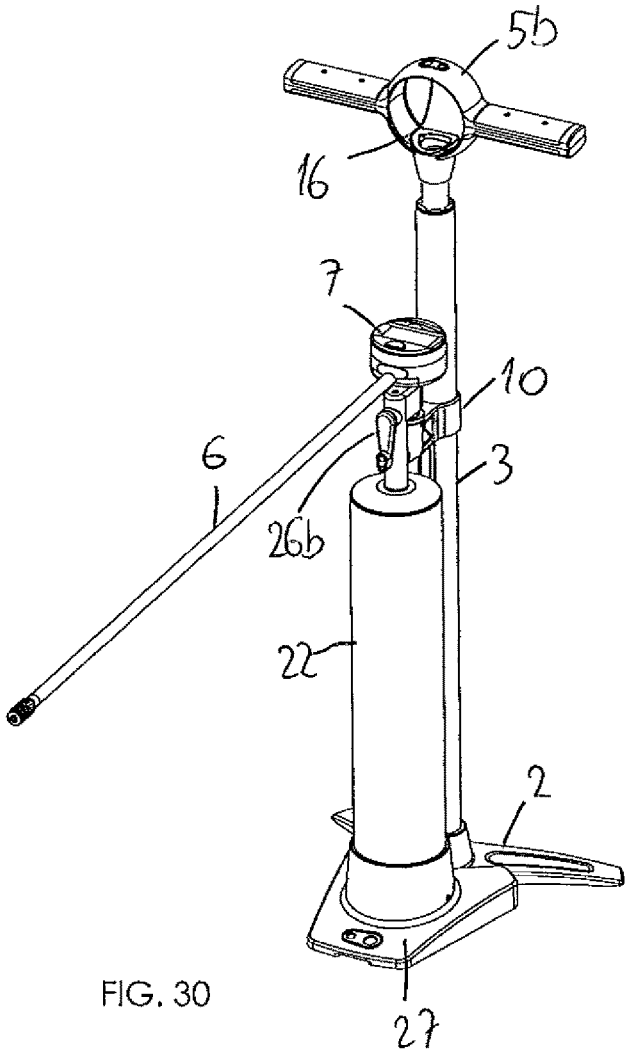
FIG. 30 shows the floor pump of FIG. 25 with a hose assembly installed and a burst tank valve in an open position.

FIG. 1 shows a typical prior art floor pump P with a flexible hose H assembly stored. Such a pump P includes a gauge G built into the base B of the pump P.

With reference now to FIGS. 3 to 24, a floor pump 1 according to an embodiment of the present invention is shown, which comprises a support base 2, an outer rigid tube 3 delimiting a first air chamber 4*a* and rising from the support base 2, an inner rigid tube or shaft 5 having a piston 5*a* at one end and a handle 5*b* at the other end, of which piston 5*a* is slidingly mounted within the first air chamber 4*a* so as to compress air or be suitable to compress air therewithin, in particular owing to a pumping action carried out by a user.

The outer 3 and inner 5 tubes are typically made of aluminum, but the same could be made of plastic or steel or other suitable materials. The handle 5*b* and the support base 2 could be die cast aluminum, but they could be made of other suitable materials.

The pump 1 further includes a flexible hose 6 having a first end 6*a* fixable to the outer rigid tube 3 and a second end 6*b* fixable to a tire valve (not shown) so that the flexible hose 6 is designed to put in fluid communication the first air chamber 4*a* with a tire valve.

The pump 1 is also equipped with a gauge or manometer 7 designed to detect and optionally show through a respective display the value of pressure of a fluid supplied inside the flexible hose 6, for example coming from the first air chamber or from a tire. Thus, the gauge 7 or the pressure detecting member thereof may intercept the fluid or air supplied from the first air chamber to the axial opening of the flexible hose and detect the pressure thereof.

Moreover, the gauge assembly 7 may be integral to the flexible hose 6, and the flexible hose 6 and the gauge 7 may be removably fixable to the outer rigid tube 3, so that the flexible hose 6 and the gauge 7 can be connected or disconnected altogether as a sole unit or assembly 67 to or from the outer rigid tube 3. Thus, the flexible hose 6 and the gauge 7 are components of the same hose assembly 67.

According to an aspect of the present invention, the way in which the flexible hose 6 and the gauge 7 can be connected or disconnected altogether as a sole unit or assembly 67 to or from the outer rigid tube 3 means that it is possible to keep the flexible hose 6 and the gauge 7 mutually connected, with the gauge intercepting or suitable for intercepting the fluid or air supplied throughout the flexible hose and suitable for detecting the pressure thereof, although the same assembly (including hose 6 and gauge 7) can be disconnected from the floor pump and connected as a sole assembly or unit to another floor pump, to a tire valve or to a burst tank, without this entailing a step of connecting the hose and the gauge to one another or a step of assembling such components separately to a floor pump, to a tire valve or to a burst tank.

For example, the flexible hose 6 or the gauge 7 comprises first fixing means or element(s) 8, whereas the outer rigid tube 3 includes second fixing means or element(s) 9 removably connectable to the first fixing means or element(s) 8. The first fixing means or the second fixing means may include at least one first magnet or removably fixing magnet 9, whereas the other among the second fixing means and the first fixing means may include a component 8 (e.g., a metallic component made of metal, such as steel or iron) that is magnetically engageable by the at least one first magnet 9. Alternatively, the first and second fixing means may be of a type different from magnetically engaging means, for example of the screw or bayonet type.

Moreover, as soon as the first fixing means or element(s) 8 are removably connected to the second fixing means or element(s) 9, the hose assembly 67 is assembled in a working position in the floor pump, for example, the hose assembly 67 is ready for detecting and optionally showing the pressure of a fluid or air supplied by the floor pump 1.

As far as the gauge assembly 7 is concerned, it may include a box-shaped body 7*a* delimiting an opening 7*b* for receiving and clamping the first end 6*a* of the flexible hose 6.

More particularly, at least one among the box-shaped body 7*a* and the outer rigid tube 3 includes at least one shank portion 7*c* provided with the first fixing means 8, whereas the other among the outer rigid tube 3 and the box-shaped body 7*a* is provided with a bracket or manifold component 10 delimiting at least one seat 11, with the second fixing means 9 being provided at the seat 11, for example, at the bottom thereof. Optionally, a first bush component 9*a* may be screwed to the inner lateral inner wall of the seat 11, thereby lining the same. Moreover, the seat or each seat 11 is designed to removably receive the shank portion or a respective shank portion 7*c*.

Such box-shape body 7*a* can be provided with two semi-shells 7*d*, 7*e* constrainable or fixable to one another, for example by means of screws 7*s*1, which semi-shells 7*d*, 7*e* delimit therebetween an area for constraining the pressure detecting member of the gauge 7, for example including a vibrating membrane, an electronic pressure transducer, optionally wired to the back of the display 7*i*, or another suitable component. The gauge could be digital or analog, and the same could be in a single piece or an assembly of parts including a battery, a display, and a housing.

In this respect, the pressure detecting member could be fixed, if desired through a securing plate 7*f*, to a plate 7*g* having a plug 7*h* designed to be sealingly connectable or connected to or inserted into the first end 6*a* of the flexible hose and the shank portion 7*c* sealingly connectable or connected to the outer rigid tube 3 or to a component thereof or connected thereto, such as the bracket or manifold component 10.

The gauge assembly 7 could also include a display 7*i*, for example constrainable or fixable to the box-shape body 7*a* or to the semi-shells 7*d*, 7*e*, for example by means of screws 7*s*2, which display 7*i* has means or element(s) for the electrical connection 7*m* of the same to the pressure detecting member, as well as an electric battery for power supplying the display 7*i*. Optionally, the gauge 7 may include also suitable means or elements for converting any value detected by the pressure detecting member into electrical signal to be shown on the display 7*i*.

A valve 7*n*, for example a first one-way valve, could also be provided in the gauge 7, which can be suitable for preventing the fluid passage from the flexible hose 6 to the outer rigid body 3, and for allowing the fluid passage from the outer rigid body 3 to the flexible hose 6. Therefore, the one way valve 7*n* is designed to prevent air loss from the tire valve when the gauge is not connected to the pump or to the burst tank.

Thus, the gauge assembly 7 substantially delimits a first flow channel FC, for the air flow from the outer rigid body 3 to the flexible hose 6, of which first flow channel FC is delimited, according to the non-limiting embodiment shown in the figures, by the pressure detecting member, for example by the plug 7*h*, the shank portion 7*c* and the plate 7*g*.

The gauge 7 could also include a unit having a pressure detector and a transmitter designed to send pressure information obtained through the pressure detector to a remote receiver, for example a computer or a phone. Such a unit could be located and locked in position inside the hose 6, for example inside an end 6*a* or 6*b* of the hose 6.

The first fixing means could comprise a flange-like tubular component 8, for example made of metal, such as iron or steel, mounted at the shank portion 7*c*. More particularly, the flange-like component 8 is fitted into the end of shank portion 7*c* distal from the plate 7*g* and protrudes therefrom or is engageable from a side opposite to the shank portion 7*c* with respect to the plate 7*g* itself.

According to the non-limiting embodiment shown in the figures, the outer rigid tube 3 includes a bracket or manifold component 10 delimiting a seat 11, optionally facing upwards, with the second fixing means, for example a first or fixing magnet 9, being provided at the seat 11.

Optionally, the outer rigid tube 3 comprises a main body 3*a*, for example with a circular cross-section, and a hollow protrusion 3*b*, e.g., slat-shaped, which extends from the main body 3*a* and delimits a first shoulder 3*c*, in use, facing upwards. More particularly, the hollow protrusion 3*b* extends along an axis substantially parallel to the main longitudinal axis of the main body 3*a* and from the base to an intermediate part thereof.

The light or conduit 3*d* defined by the hollow protrusion 3*b* is in fluid communication, for example at the bottom thereof, with the first air chamber 4*a* and opens out at a hole 3*e*.

So far as the bracket or manifold component 10 is concerned, it may include a socket body delimiting an axial opening 10*a* for insertion and sized to fit, for example, the outer rigid body 3. The bracket component 10 can delimit a second shoulder 10*b*, optionally facing downwards, designed to abut against the first shoulder 3*c* when the outer rigid tube 3 is inserted into the axial opening 10*a* delimited by the bracket component 10, so as to define the work position of the bracket or manifold component 10 with respect to the outer rigid tube 3.

The floor pump 1 may include a pin element 10*h* (see FIG. 9 or 16) designed to be press fitted into a hole extending from the light or conduit 3*d* up to the first shoulder 3*c*, of which pin element 10*h* is designed to seal the light or conduit 3*d* (at the upper, in use, end thereof) defined by the hollow protrusion 3*b*. Should a pin 10*h* be provided, it would be prevented from outward movement by the shoulder 10*b*.

The manifold component 10 can be connected to the outer rigid tube 3 by means of a first dowel or pin component 10*c* fixable, for example by screwing, into a suitable opening the socket component 10, optionally after the mounting step of the latter with the outer rigid tube 3. In use, the first dowel component 10*c* is designed to protrude into the hole 3*e* of the hollow protrusion 3*b*.

The first dowel component 10*c* may include a tubular hollow element having at a first end fittable into the hole 3*e*, one or more first transverse holes 10*d*, whereas at the other or second end one or more second transverse holes 10*e*. More particularly, the second transverse holes open at an annular recess 10*f*.

The manifold component 10 can delimit a second flow channel SC, for the fluid communication of the light or conduit 3*d* with the first flow channel FC of the gauge 7 or with the flow channel delimited by the flexible hose 6.

More particularly, the second flow channel SC can be delimited by the first dowel component 10*c*.

The bracket component 10 could also be provided with a first nozzle or pipe fitting component 10*g* protruding up to the seat 11 and insertable, optionally to size, into the flange-like component 9. The nozzle component 10*f* delimits a second section SC2 of the second flow channel SC, optionally transverse or orthogonal to the first section SC1 delimited by the first dowel component 10*c*.

The second flow channel SC could also include an intermediate section SC3 delimited by the bracket component 10 and designed to put in fluid communication the first SC1 and second SC2 section.

So far as the inner rigid tube 5 is concerned, the same may be hollow and delimit an inner space 12, and in such case, the flexible hose 6 is insertable in the inner space 12, so as to be stored therein.

More particularly, the inner rigid tube 5 includes an inner space 12 extending along the longitudinal main axis of the inner rigid tube 5 and with an inlet opening facing, in use upwards or, in any case, with an inlet opening at the handle 5*b*.

For example, the flexible hose 6 is provided with first connecting means or element(s) 6*c*, whereas the inner tube 5 or the outer tube 3 or the support base 2 is provided with second connecting means or element(s) 15 designed to be removably connected with the first connecting means when the flexible hose is inserted in the inner space 12.

Moreover, in order to pump air out of the first air chamber 4*a* the inner rigid tube 5 is displaceable with respect to the outer rigid tube 3 between a lowered or pushing position (see FIG. 10) and a raised or suctioning position (see FIG. 15), and the second connecting means 15 is designed to be removably connected with the first connecting means 6*c* when the flexible hose is inserted in the inner space 12 and when the inner rigid tube 5 is in the lowered or pushing position, whereas when the inner rigid tube 5 is in the raised or suctioning position, the second connecting means 15 is detached and neither connected nor connectable to the first connecting means 6*c*.

The first connecting means or the second connecting means may include at least one second or connecting magnet 15, whereas the other among the second connecting means and the first connecting means includes a component 6*c* (e.g., a metallic component made of metal, such as steel or iron) that is magnetically engageable by the at least one second magnet 15. Alternatively, the first and second connecting means may be of a type different from magnetically engaging means, for example of the screw or bayonet type.

The first connecting means 6*c* can be provided at the second end 6*b* of the flexible hose 6, whereas the second connecting means 15 is provided at the support base 2 or at the bottom, in use, of the outer rigid body 2. For example, the second connecting means 15 is firmly received in a recessed area formed in the support base 2 or at the bottom, in use, of the outer rigid body 2.

According to the non-limiting embodiment shown in the figures, the inner rigid tube 5, includes a main tubular element 5*c* and a cap or piston component 5*a* mounted on the lower, in use, end of the main tubular element 5*c*. The cap component 5*a* can be optionally provided with a tapered structure or a tip 5*d* with a diameter or width lower than the remainder of the same component 5*a*.

At least the piston 5*a* of such inner rigid tube 5 is made of a material, such as plastic or the like that is non-magnetic material, which is not suitable for magnetic engagement or for being attracted by a magnet, whereas a second or connecting magnet 15 is fitted into the support base 2, more particularly at the lower, in use, end of the first air chamber 4.

The magnet 15 is designed to hold the handle assembly closed when the hose assembly 67 is stored, and also to secure the hose assembly 67 in position.

The flexible hose 6 can be provided with a connector 6*c*. Such connector can be made of metal, such as iron or steel, which is inserted or pitched into the second end 6*b* and designed to magnetically engage as above indicated the magnet 15.

The connector 6*c* may be reversible to fit both presta and schrader tire valves.

The hose 6 could also include a locking ring, for example threaded 6*d* for constraining the connector 6*c* to the flexible hose 6. Moreover, a second nozzle or pipe fitting component 6*e* can be provided fitted into the second end 6*b* of the flexible hose 6.

More particularly, the flexible hose 6 has a length substantially corresponding or slightly (e.g., 1-10 cm or 2-5 cm) above the length of the inner space 12 delimited by the inner tube 5, so that the flexible hose 6 can be substantially wholly received or receivable within the inner space 12.

Regarding the gauge 7, the handle 5*b* or the inner tube 5 can delimit a housing or receiving zone 16, e.g., ring-shaped, for housing or receiving and optionally protecting the gauge 7. The handle 5*b* may include an intermediate ring-shaped section 5*b*1 and two wing handgrip portions 5*b*2, 5*b*3, each extending from a respective side of the intermediate ring-shaped section 5*b*1.

The handle 5*b* can include several parts (as shown) or the same could be made of a single piece.

In this respect, if the gauge 7 is integral to the flexible hose 6 and the flexible hose 6 and the gauge 7 are removably fixable to the outer rigid tube 3, the gauge 7 can be housed or received in the housing or receiving zone 16 when the flexible hose 6 is inserted in the inner space 12.

In this case, the upper, in use, end 5*e* of the inner rigid tube is integral or fixed to the handle 5*b* and opens out at the housing or receiving zone 16.

When the hose assembly 67 is in the stored position, the entire handle 5*b* is held closed enough to make it possible to lift the pump by the handle 5*b* without the handle 5*b* pulling away from the support base 2, since the first connection means engages the second connecting means and the gauge 7 pushes the upper end of the inner rigid tube 5 and the handle 5*b* integral therewith towards the support base 2.

Referring now to the fluid communication between the first air chamber 4*a* and the flexible hose 6, the support base 2 delimits a fluid or air conveying length 19 extending from the first air chamber 4*a*, in particular from the lower end thereof, to an opening, for example a lower, in use, opening, delimited by the hollow protrusion 3*b* or a second dowel component 20. In this regard, optionally a second dowel component 20 can be provided for fixing by screwing, the hollow protrusion 3*b* to the support base 2, which second dowel component 20 is designed to be inserted into a hole delimited by the support base 2 up to protrude and screw engage an end, for example a lower, in use, end of the hollow protrusion 3*b*.

So far as the air inlet into the first air chamber 4*a* is concerned, an O-ring 17 or the like could be provided between the cap component 5*a* and the inner wall of the outer rigid tube 3, which O-ring is arranged and designed to keep the fluid seal when the inner rigid tube 5 is pushed from the raised or suctioning position to the lowered or pushing position and to deform in such a way as to allow the fluid or air passage from the outside in the first air chamber 4*a*, when the inner rigid tube 5 is raised from the lowered or pushing position to raised or suctioning position.

According to the non-limiting embodiment shown in the figures, the piston or cap component 5*a* can delimit a mounting seat 5*a*1 for the O-ring 17, which seat 5*a*1 is defined between a solid flange or annular protrusion 5*a*2 extending from the outer wall of the cap component 5*a* and an interrupted flange or a number of lugs 5*a*3 also extending from the outer wall of the cap component 5*a*, optionally at a distance from to the tip of the cap component 5*a* lower than the solid flange 5*a*2 and at a distance from the handle 5*b* greater than the solid flange 5*a*2. Owing to this expedient, during the upstroke, i. e. when the inner rigid tube 5 is raised from the lowered or pushing position to raised or suctioning position, the O-ring 17 can flex in a way that allows air to enter the first air chamber 4. Thus, the piston assembly can act as a one way valve.

In this respect, the lower part of the inner rigid tube 5, if desired the tapered structure or tip 5*c* thereof, is designed to slidingly engage the lower, in use, end of the first air chamber 4*a*, so as to compress the fluid or air inside the first air chamber 4*a* and to thrust the same up to the flexible hose 6, optionally causing the pressed air to flow throughout the light or conduit 3*d* defined by the hollow protrusion 3*b*, then into the flow channels FC and SC, and at the end into the flexible hose 6 for inflating a tire.

The floor pump 1 may be provided with suitable sealing or O-ring elements, arranged in particular to prevent fluid or air leakages from the first air chamber 4*a* to the flexible hose 6. In this respect, sealing means is provided between the inner rigid tube or shaft 5, optionally at the piston 5*a*, and the inner surface of the outer rigid tube 3, in such a way as an inner light or conduit 4 delimited by the outer rigid tube 3 is severed between two portions 4*a*, 4*b*, with a first portion or end portion 4*a*, in use, lower, corresponding to the first air chamber 4*a* (see in particular FIG. 15).

Referring now to FIGS. 25 to 36, another floor pump according to an embodiment of the present invention is shown, which comprises a burst tank 22 delimiting a second air chamber 23, of which burst tank 22 is removably fixable to the outer rigid tube 3 in such a way as when the burst tank 22 and the outer rigid tube 3 are fixed to one another, the second air chamber 23 is or can be put (following the adjustment of a valve described hereinafter) in fluid communication with the first air chamber 4. Moreover, the flexible hose 6 and the gauge 7 can be connected or disconnected altogether as a sole unit or assembly to or from the burst tank 22.

According to an aspect of the present invention, a "burst tank" is a tank designed to help seat a tubeless tire on a rim by providing a high flow (blast) of air into the tire. More particularly, the "burst tank" is inflated by a floor pump, for example to about 160 psi and then the air within the burst tank is released rapidly into the tire.

In this case, the flexible hose 6 or the gauge 7 comprises first fixing means, whereas the burst tank includes third fixing means 24 removably connectable or connected to the first fixing means or element(s) 8.

Advantageously, at least one among the box-shaped body of the gauge 7 and the burst tank 22 includes a shank portion provided with first or third, respectively, fixing means, whereas the other among the burst tank 22 and the box-shaped body 7*a* delimits a seat having third or first, respectively, fixing means removably connectable to the first or third fixing means.

Moreover, if the outer rigid tube 3 includes second fixing means, the burst tank 22 includes fourth fixing means 25 removably connectable to the second fixing means.

For example, the first fixing means or element(s) are similar if not identical to the fourth fixing means or element(s), whereas the third fixing means or element(s) are similar if not identical to the second fixing means, since both the first fixing and the fourth fixing means should be removably engageable with the second fixing means, whereas both the second fixing and the third fixing means should be removably engageable with the first fixing means.

The burst tank 22 can also be provided with a valve group 26 designed to open/close or adjust the fluid communication of the second air chamber of the burst tank 22 with the first chamber 4*a* and/or with the flexible hose 6. More particularly, the valve group 26 can be displaced between a first or closed position, in which the first chamber 4*a* is in fluid communication with the burst tank 22 only and not with the flexible hose 6, and a second or open position, in which the first chamber 4*a* is in fluid communication both with the burst tank 22 and with the flexible hose 6 or hose assembly 67.

According to the non-limiting embodiment shown in the figures, the burst tank 22 includes a basement 27 mountable or removably fixable on the floor or on the support base 2, a side wall 28, for example with circular cross-section rising from the basement 27.

The burst tank 22 can be obtained through components made of steel or of other suitable materials, which are suitably welded to one another.

More particularly, the basement 27 of the burst tank 22 may include a finger 27*a* that engages with a hole 2*a* of floor pump support base 2. In this way, the burst tank 22 is locked on the pump 1 by the connection, optionally magnetic, among third and second fixing means and by the finger 27*a* engaging with hole 2*a*.

Moreover, a closure element 29 can be mounted, for example welded or screwed at the end of the side wall 28 distal from the basement 27.

The closure element 29 delimits a through hole 30, and the burst tank 22 further includes a hollow tubular element 31, which can be mounted in the through hole 30, in such a way that the respective inner opening is in fluid communication with the second air chamber 23. In this respect, the lower, in use, end of the hollow tubular element 31 may be threaded and designed to screw engage with a ring nut 29*a* or the like constrained to the closure element 29, for example by means of an annular pushing element 29*b*, e.g. screw engaged with a respective wall of the closure element 29.

Moreover, a spring loaded over pressure relief valve or a plug could also be provided in the burst tank 22, which relief valve would be in the bottom of the side wall 28 in order to prevent air escaping and/or to vent out moisture, should moisture get inside. Alternatively, the bottom of the side wall 28 could simply be made without a hole.

More particularly, the hollow tubular element 31 includes a first length 31*a* terminating with an elbow end 31*b* supporting a second length 31*c*, optionally parallel to the first length 31*a*, at an intermediate part thereof.

In this case, the third fixing means 24 could be provided at the upper, in use, end of the second length 31*c*, whereas the fourth fixing means 25 could be provided at the lower, in use, end of the second length 31*c*.

For example, the first fixing means or the third fixing means includes at least one first magnet or removably fixing magnet 9, whereas the other among the third fixing means and the first fixing means includes a second metallic component 24 (e.g., a component made of metal, such as steel or iron) that is magnetically engageable by the at least one magnet. The second metallic component 24 may include a sleeve or flange-like tubular component or the like engageable, for example screwable or fittable in an end of the hollow tubular element 31, for example in the lower, in use, end thereof or of the second length 31*c*.

The second fixing means or the fourth fixing means includes at least one third magnet or removably anchoring magnet 25, whereas the other among the fourth fixing means and the second fixing means includes a metallic component 8 (e.g., a component made of metal, such as steel or iron) that is magnetically engageable by the at least one magnet. The metallic component 8 may include the above-mentioned first metallic component. The third magnet or removably anchoring magnet 25 may be engaged, for example screwed or fitted in an end of the hollow tubular element 31, for example in the upper, in use, end thereof or of the second length 31*c*. Optionally, a second bush component 31*e* can be connected or screwed into the upper, in use, end of the second length 31*c*.

Moreover, a third nozzle or pipe fitting component 31*f* can be provided in the hollow tubular element 31.

As relates to the valve group 26, it may include a stem element 26*a* having respective holes formed therein and insertable throughout an opening 31*d* formed in the hollow tubular element 31 and designed to open/close or adjust the fluid communication between the second air chamber 23 and the flexible hose 6 and the fluid communication between the second air chamber 23 and the first air chamber 4. The valve group 26 could also comprise a crank element 26*b* integral or fixed to the stem element 26*a* for controlling the angular displacement thereof and, optionally, with a removable locking means 33, such as a screw of the like, designed to be inserted in respective holes or openings of the hollow tubular element 31 and of the stem element 26*a*, so as to fix, if required, in position the stem element 26*a* with respect to the valve body, i. e. the hollow tubular element 31.

The burst tank 22 is optionally provided with a second one-way valve 34 arranged to prevent the fluid passage from the second air chamber 23 to the first air chamber 4*a*, and to allow the fluid passage from the first air chamber 4*a* to the second air chamber 23 or to the flexible hose 6.

In this respect, when the stem element 26*a* is turned about 90°, a sealing disc 35 seals the valve assembly 23 closed.

With the burst tank valve group 26 in its "open" position, pumping would simultaneously fill the burst tank 22 and the tire. If valve group 26 were closed, then pumping would fill only the burst tank 22. Then, after the burst tank 22 is filled to the desired pressure, opening valve group 26 would rapidly fill the tire. Alternatively, burst tank 22 could be removed from the pump without any loss of air and used independently together with the hose assembly 67.

Figure 31:
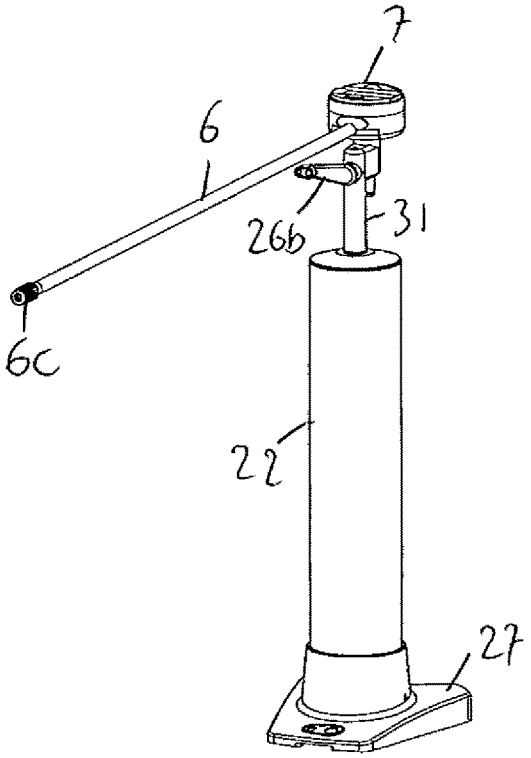
FIG. 31 shows a burst tank with a hose assembly and a valve in a closed position according to an embodiment of the present invention.
Figure 32:
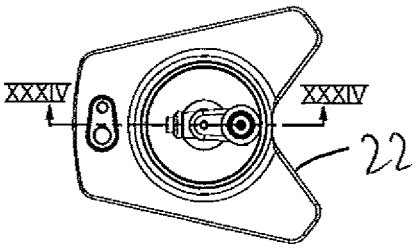
FIGS. 32 and 33 show a top and side view, respectively, of the burst tank of FIG. 31.
Figure 33:
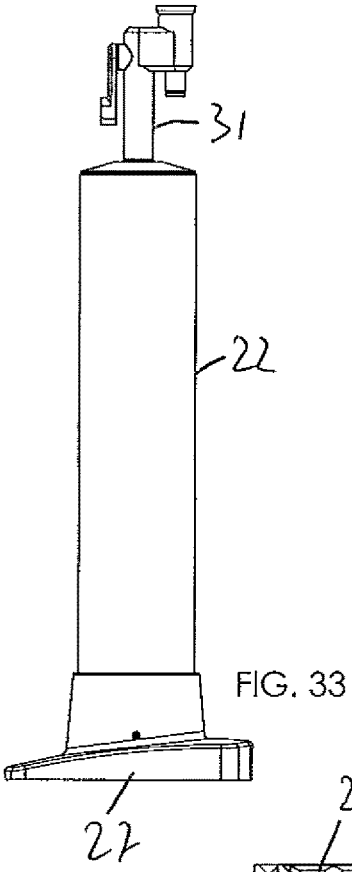
Figure 34:
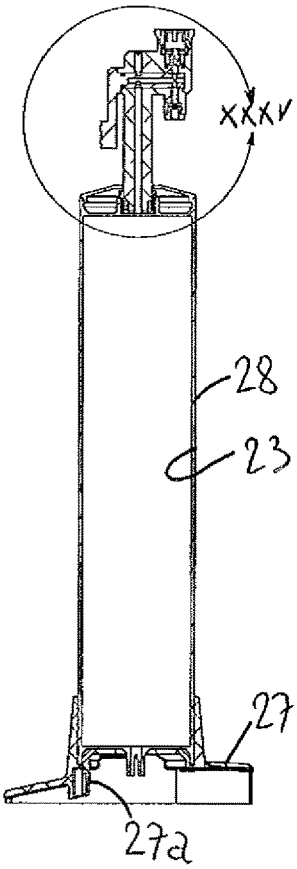
FIG. 34 shows a cross-section view taken along the line XXXIV-XXXIV of FIG. 32.
Figure 35:
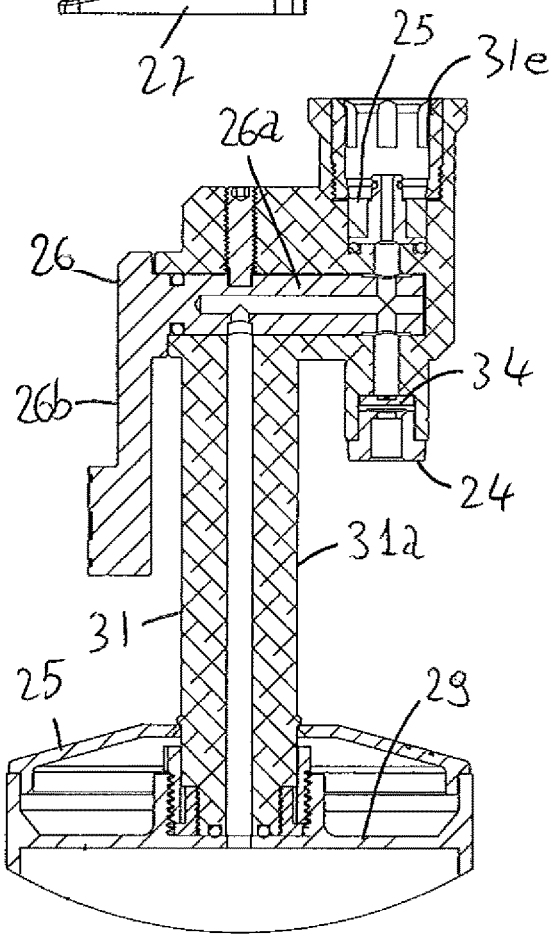
FIG. 35 shows an enlarged view taken along the line XXXV of FIG. 34.
Figure 36:
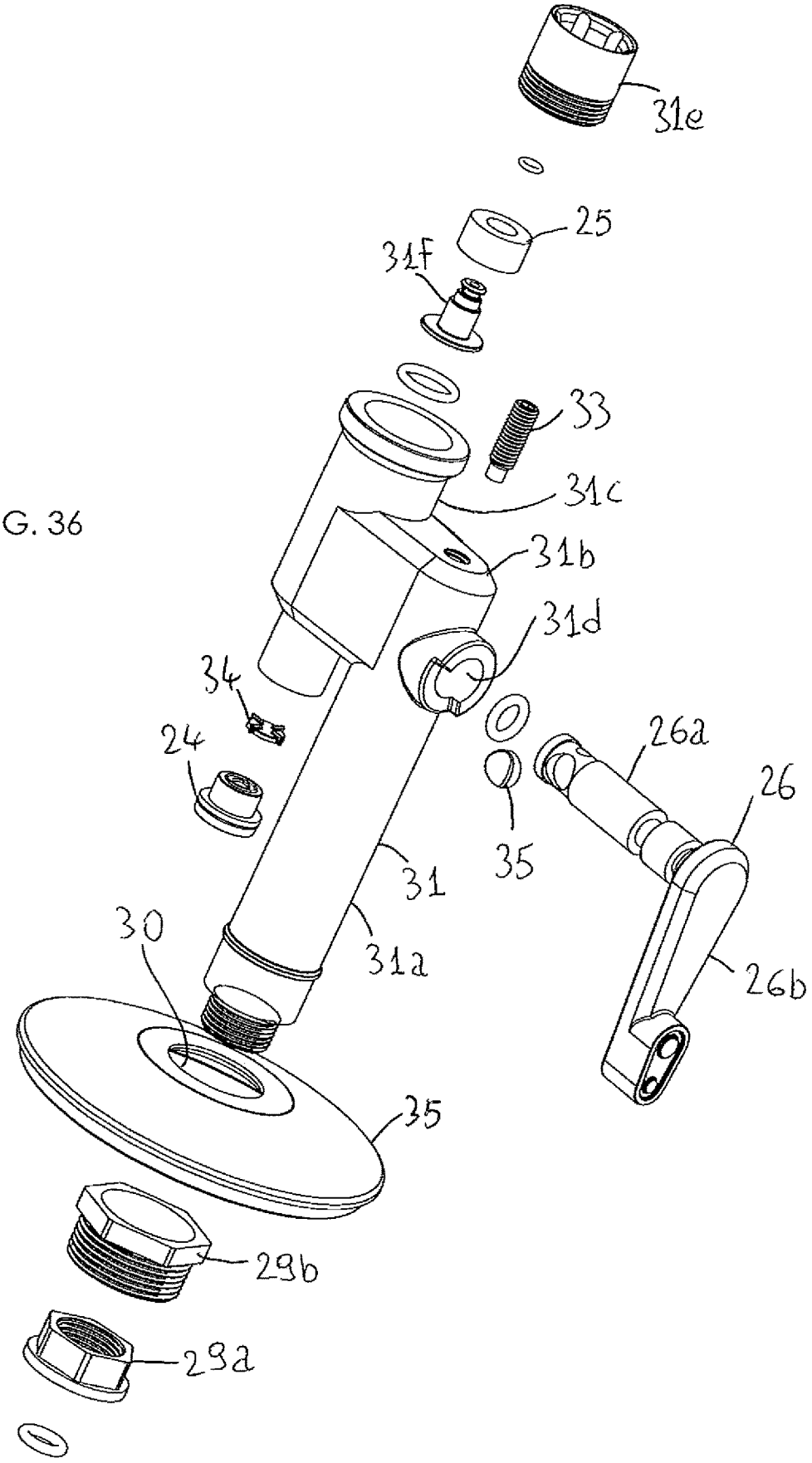
FIG. 36 shows an exploded view of a valve assembly of the burst tank of FIG. 31.

In this respect, FIG. 31 shows a burst tank removed from the floor pump and ready to inflate a tire (after it is connected to a tire valve), with the burst tank valve group 22 in a "closed" position.

The burst tank 22 may be provided with suitable sealing or O-ring elements.

Moreover, a masking component 35 can be mounded at the top of the burst tank and in such a way as to hide the closure element 29.

As it will be appreciated, a hose assembly 67 detects and optionally shows the value of pressure of a fluid supplied by a floor pump 1, by a burst tank 22, or of a tire either independently from the floor pump 1 or the burst tank 22 or in combination with a floor pump or a burst tank.

In this respect, the gauge 7 of the hose assembly 67 can be used:

on the floor pump 1 when the burst tank 22 is not installed;

on the floor pump 1 when the burst tank 22 is installed;

on the burst tank 22 when the burst tank 22 is used independently; and/or as an independent pressure gauge 7.

Therefore, the gauge 7 with the respective hose assembly 67 can be used in at least four ways, which is both convenient and economical.

Usually, independent floor gauge displays are small and hard to read, whereas this one can be larger and easier to read.

Moreover, the handle 5*b* is firmly, for example magnetically, held closed only when the pump 1 is stored and thus it does not interfere at all during pumping use.

The hose assembly instead has a head (e.g., made of steel) which, when stored inside the handle/tube assembly, holds, for example magnetically, the piston to the base. In this way, the magnetic connection only occurs during storage, and therefore it does not interfere when pumping air as happens with the solution of U.S. Pat. No. 9,057,364.

The magnetic connection not only holds the handle/tube assembly closed, but it also keeps the gauge assembly firmly in position within the handle/tube assembly. When the gauge assembly is almost wholly inserted into the handle/tube assembly, magnetic force pulls the gauge completely within the handle.

Moreover, when stored, the gauge can be protected within the handle assembly, and this ensures a protection for the gauge from damage if the pump tips oven when stored.

The flexible hose can also be conveniently stored inside the inner tube, making the pump more compact and neat, and preventing a tripping hazard.

So far as the burst tank is concerned, it is both independent and essentially integrated. The burst tank does not require its own hose, head, or gauge, as the hose and gauge assembly from the main floor pump is used.

The burst tank fits to the floor pump in an integrated fashion, yet can be removed for independent use. In this way, the burst tank is only connected to the pump during the short period required, and thus no useless weight or size is required.

As it will be appreciated, the cost of such solution is lower than known solutions. The burst tank can be pumped up and then removed from the floor pump without any or only minimal air loss.

The magnetic connection between the gauge and the pump (or the burst tank), if provided, is extremely easy and fast.

The magnetic pull is enough to achieve air pressures higher than typically pumping pressures, yet weak enough to pull apart for storage. In this respect, with a ½ inch outer diameter by ¼ inch inner diameter by ¼ inch thick neodymium magnet, the pull force is about 8.7 pounds. With a sealing diameter of 0.200 inches (surface area of 0.0314 square inches), the magnet can withstand a pressure of 277 psi (8.7/0.0314).

Floor pumps are normally only used up to about 160 psi (also the limit of nearly all bicycle tires), so this allows plenty of extra hold during pumping. It is apparent that 8.7 pounds of pull is strong enough for air pressure, yet weak enough to easily pull apart when storing the pump.

If there is concern that the pump itself (or the burst tank) can only withstand a certain amount of pressure, the magnet can be chosen to be weak enough to disconnect at the desired pressure, preventing damage or a dangerous situation.

Moreover, the gauge magnetically connects to the pump and burst tank in such a way that the gauge can swivel without loss of air. This allows the hose to more conveniently reach the tire valves.

The present invention has been described according to exemplary embodiments, but equivalent variants can be devised without departing from the scope offered by the following claims.

The invention claimed is:

1. A floor pump comprising:

a support base;

an outer rigid tube rising from said support base and delimiting a first air chamber;

an inner rigid tube or shaft having a piston at one end and a handle at the other end, wherein said piston is slidingly mounted within said first air chamber so as to compress air within said first air chamber; and a flexible hose having a first end fixable to said outer rigid tube and a second end fixable to a tire valve so that said flexible hose is able to put in fluid communication the end of the first air chamber with a tire valve, wherein said inner rigid tube is hollow and delimits an inner space, and wherein said flexible hose is insertable in said inner space, so as to be stored therein, wherein said flexible hose is provided with first connecting means or element, whereas said inner rigid tube or said outer rigid tube or said support base is provided with second connecting means or element removably connected with said first connecting means when said flexible hose is inserted in said inner space, further comprising a gauge or a manometer designed to detect and/or show a value of pressure of a fluid supplied inside said flexible hose, and wherein said handle or said inner rigid tube delimits a housing or receiving zone for housing or receiving said gauge or said manometer, further comprising a burst tank delimiting a second air chamber removably fixable to said outer rigid tube such that when said burst tank and said outer rigid tube are fixed to one another, said second air chamber is in fluid communication with said first air chamber, wherein said flexible hose and said gauge can be connected or disconnected as a sole unit or assembly to or from said burst tank, wherein said gauge includes a box-shaped body delimiting an opening for receiving and clamping said first end of said flexible hose, and wherein at least one among said box-shaped body and said burst tank includes at least one shank portion provided with first or third fixing means, whereas the other among said burst tank and said box-shaped body is provided with a bracket delimiting at least one seat having third or first fixing means removably connectable or connected to said first or third fixing means.

2. A floor pump comprising:

a support base;

an outer rigid tube rising from said support base and delimiting a first air chamber;

an inner rigid tube or shaft having a piston at one end and a handle at the other end, wherein said piston is slidingly mounted within said first air chamber so as to compress air within said first air chamber; and a flexible hose having a first end fixable to said outer rigid tube and a second end fixable to a tire valve so that said flexible hose is able to put in fluid communication the end of the first air chamber with a tire valve, wherein said inner rigid tube is hollow and delimits an inner space, and wherein said flexible hose is insertable in said inner space, so as to be stored therein, wherein said flexible hose is provided with first connecting means or element, whereas said inner rigid tube or said outer rigid tube or said support base is provided with second connecting means or element removably connected with said first connecting means when said flexible hose is inserted in said inner space, further comprising a gauge or a manometer designed to detect and/or show a value of pressure of a fluid supplied inside said flexible hose, and wherein said handle or said inner rigid tube delimits a housing or receiving zone for housing or receiving said gauge or said manometer, further comprising a burst tank delimiting a second air chamber removably fixable to said outer rigid tube such that when said burst tank and said outer rigid tube are fixed to one another, said second air chamber is in fluid communication with said first air chamber, wherein said flexible hose and said gauge can be connected or disconnected as a sole unit or assembly to or from said burst tank, and whereas said outer rigid tube includes second fixing means, whereas said burst tank includes fourth fixing means removably connectable or connected to said second fixing means.

3. A floor pump comprising:

a support base;

an outer rigid tube rising from said support base and delimiting a first air chamber;

an inner rigid tube or shaft having a piston at one end and a handle at the other end, wherein said piston is slidingly mounted within said first air chamber so as to compress air within said first air chamber; and a flexible hose having a first end fixable to said outer rigid tube and a second end fixable to a tire valve so that said flexible hose is able to put in fluid communication the end of the first air chamber with a tire valve, wherein said inner rigid tube is hollow and delimits an inner space, and wherein said flexible hose is insertable in said inner space, so as to be stored therein, wherein said flexible hose is provided with first connecting means or element, whereas said inner rigid tube or said outer rigid tube or said support base is provided with second connecting means or element removably connected with said first connecting means when said flexible hose is inserted in said inner space, and further comprising a gauge or a manometer designed to detect and/or show a value of pressure of a fluid supplied inside said flexible hose, and wherein said handle or said inner rigid tube delimits a housing or receiving zone for housing or receiving said gauge or said manometer, wherein said flexible hose or said gauge comprises first fixing means, whereas said outer rigid tube includes second fixing means removably connectable or connected to said first fixing means, wherein said gauge includes a box-shaped body delimiting an opening for receiving and clamping said first end of said flexible hose, and wherein at least one among said box-shaped body and said outer rigid tube includes at least one shank portion provided with said first fixing means, whereas the other among said outer rigid tube and said box-shaped body is provided with a bracket or manifold component delimiting at least one seat, said second fixing means being provided at said at least one seat, said at least one seat being designed to removably receive said at least one shank portion.

4. The floor pump of claim 3, wherein said inner rigid tube is displaceable with respect to said outer rigid tube between a lowered or pushing position and a raised or suctioning position, and wherein said second connecting means is removably connected with said first connecting means when said flexible hose is inserted in said inner space and when said inner rigid tube is in said lowered or pushing position, whereas when said inner rigid tube is in said raised or suctioning position, said second connecting means is detached and neither connected nor connectable to said first connecting means.

5. The floor pump of claim 3, wherein said first connecting means is provided at said second end of said flexible hose, whereas said second connecting means is provided at said support base or at the bottom, in use, of said outer rigid tube.

6. The floor pump of claim 3, wherein said gauge or said manometer is integral to said flexible hose, wherein said flexible hose and said gauge or said manometer are removably fixable to said outer rigid tube, so that said flexible hose and said gauge or said manometer is connectable or disconnectable as a sole unit or assembly to or from said outer rigid tube, and wherein said gauge or said manometer is housed or received in said housing or receiving zone when said flexible hose is inserted in said inner space.

7. The floor pump of claim 3, wherein said first fixing means or said second fixing means includes at least one first magnet or removably fixing magnet, whereas the other among said second fixing means and said first fixing means includes a component magnetically engageable by said at least one first magnet.

8. The floor pump of claim 3, wherein said gauge includes a pressure detector and a transmitter configured to send pressure information obtained through the pressure detector to a remote receiver.

9. The floor pump of claim 3, wherein said first connecting means or said second connecting means includes at least one connecting magnet, whereas the other among said second connecting means and said first connecting means includes a component magnetically engageable by said at least one connecting magnet.

10. The floor pump of claim 9, wherein at least the piston of said inner rigid tube is made of a non-magnetic material not suitable for magnetic engagement.

11. The floor pump of claim 3, wherein said outer rigid tube includes a bracket or a manifold component delimiting said at least one seat, said bracket or manifold component including a socket body delimiting an axial opening to be inserted into and sized to fit said outer rigid tube.

12. The floor pump of claim 11, wherein said outer rigid tube comprises a main body and a hollow protrusion extending from the main body and delimiting a first shoulder, in use, facing upwards, whereas a conduit defined by said hollow protrusion is in fluid communication with said first air chamber, and wherein said bracket or manifold component delimits a second shoulder designed to abut against said first shoulder when said outer rigid tube is inserted into said axial opening delimited by said bracket or manifold component, so as to define a work position of the bracket or manifold component with respect to said outer rigid tube, and wherein said bracket or manifold component delimits a second flow channel for the fluid communication of said conduit with first flow channel of said gauge or with flow channel delimited by said flexible hose.

13. The floor pump of claim 3, further comprising a burst tank delimiting a second air chamber removably fixable to said outer rigid tube such that when said burst tank and said outer rigid tube are fixed to one another, said second air chamber is in fluid communication with said first air chamber, wherein said flexible hose and said gauge can be connected or disconnected as a sole unit or assembly to or from said burst tank.

14. The floor pump of claim 13, wherein said flexible hose or said gauge comprises first fixing means, whereas said burst tank includes third fixing means removably connectable or connected to said first fixing means.

15. The floor pump of claim 13, wherein said gauge includes a box-shaped body delimiting an opening for receiving and clamping said first end of said flexible hose, and wherein at least one among said box-shaped body and said burst tank includes at least one shank portion provided with first or third fixing means, whereas the other among said burst tank and said box-shaped body is provided with a bracket delimiting at least one seat having third or first fixing means removably connectable or connected to said first or third fixing means.

16. The floor pump of claim 13, whereas said outer rigid tube includes second fixing means, whereas said burst tank includes fourth fixing means removably connectable or connected to said second fixing means.

17. The floor pump of claim 13, wherein said burst tank includes a valve group designed to open/close or adjust the fluid communication of said second air chamber of said burst tank with said first air chamber and/or with said flexible hose.

* * * * *